US007827779B1

(12) United States Patent
Krishnan et al.

(10) Patent No.: US 7,827,779 B1
(45) Date of Patent: Nov. 9, 2010

(54) LIQUID METAL ION THRUSTER ARRAY

(75) Inventors: Mahadevan Krishnan, Oakland, CA (US); Kristi Wilson, El Cerrito, CA (US); Kelan Champagne, Alameda, CA (US); Jason D. Wright, San Mateo, CA (US); Andrew N. Gerhan, San Francisco, CA (US)

(73) Assignee: Alameda Applied Sciences Corp., San Leandro, CA (US)

( * ) Notice: Subject to any disclaimer, the term of this patent is extended or adjusted under 35 U.S.C. 154(b) by 606 days.

(21) Appl. No.: 11/900,372

(22) Filed: Sep. 10, 2007

(51) Int. Cl.
*F03H 1/00* (2006.01)

(52) U.S. Cl. ..... 60/202; 313/360.1; 313/361.1; 315/111.81

(58) Field of Classification Search ..... 60/202; 313/360.1, 361.1, 362.1, 363.1; 315/111.81
See application file for complete search history.

(56) References Cited

U.S. PATENT DOCUMENTS

| | | | | |
|---|---|---|---|---|
| 3,311,772 | A * | 3/1967 | Speiser et al. | 313/361.1 |
| 4,328,667 | A | 5/1982 | Valentian et al. | |
| 4,367,429 | A * | 1/1983 | Wang et al. | 313/362.1 |
| 4,453,078 | A * | 6/1984 | Shimizu | 250/425 |
| 4,577,461 | A | 3/1986 | Cann | |
| 4,680,507 | A * | 7/1987 | Uemura et al. | 315/111.81 |
| 5,924,277 | A * | 7/1999 | Beattie et al. | 60/202 |
| 5,973,447 | A | 10/1999 | Mahoney et al. | |
| 6,097,139 | A | 8/2000 | Tuck et al. | |
| 6,337,540 | B1 * | 1/2002 | Corbin et al. | 315/111.21 |
| 6,516,604 | B2 | 2/2003 | Mojarradi et al. | |
| 6,531,811 | B1 | 3/2003 | Kudo et al. | |
| 6,656,831 | B1 * | 12/2003 | Lee et al. | 438/627 |
| 6,738,952 | B1 | 5/2004 | Yamamuro | |
| 6,741,025 | B2 | 5/2004 | Tuck et al. | |
| 6,996,972 | B2 | 2/2006 | Song | |
| 7,059,111 | B2 | 6/2006 | King | |
| 7,405,411 | B2 * | 7/2008 | Walton | 250/423 R |
| 7,420,181 | B2 * | 9/2008 | Kaga et al. | 250/423 R |
| 7,696,489 | B2 * | 4/2010 | Pilz et al. | 250/423 R |
| 2009/0278434 | A1 * | 11/2009 | Holland et al. | 313/306 |

OTHER PUBLICATIONS

Swanson and Li, "Influence of Electrode Geometry on Liquid Metal Ion Source Performance", J. Vacuum Sci Tech, Jul./Au. 1988 p. 1062-1065.

(Continued)

*Primary Examiner*—Michael Cuff
*Assistant Examiner*—Phutthiwat Wongwian
(74) *Attorney, Agent, or Firm*—File-EE-Patents.com; Jay A. Chesavage

(57) ABSTRACT

A Liquid Metal Ion Thruster (LMIT) has a substrate having a plurality of pedestals, one end of the pedestal attached to the substrate, and the opposing end of the pedestal having a tip, the pedestals having grooves and the substrate also having grooves coupled to each other and to a source of liquid metal. An extractor electrode positioned parallel to the substrate and above the pedestal tips provides an electrostatic extraction field sufficient to accelerate ions from the tips of the pedestals through the extractor electrode. A series of focusing electrodes with matching apertures provides a flow of substantially parallel ion trajectories, and an optional negative ion source provides a charge neutralization to prevent space charge spreading of the exiting accelerated ions. The assembly is suitable for providing thrust for a satellite while maintaining high operating efficiencies.

20 Claims, 6 Drawing Sheets

OTHER PUBLICATIONS

Bell & Swanson, "Influence of Substrate Geometry on the Emission Properties of a Liquid Metal Ion Source", Applied Physics Solids & Surfaces, 1986, 335-346.

Thompson & Plewett, "Dynamics of Liquid Metal Ion Sources", J. Physics Applied Physics, 1984, 2305-2321.

L.W. Swanson, Liquid Metal Ion Sources, Mechanisms & Applications, Nuclear Inst. & Methods in Phys Research, 1983, 347-353.

A. Wagner, The Hydrodynamics of Liquid Metal Ion Sources, Applied Phys Letters 40(5), Mar. 1, 1982, p. 440-442.

A. Wagner "Liquid Gold Ion Sources", J. Vacuum Sci Tech, 16(6) Nov./Dec. 1979 p. 1871-1874.

* cited by examiner

Un-wetted surface

Plasma assist wetted surface

Bulk Indium

After surface heating

Insulated Extraction Electrode w/focus electrodes & charge neutralizer

Section A–A

Liquid phase ion source w/ solid phase electron source

LIQUID METAL ION THRUSTER ARRAY

FIELD OF THE INVENTION

The present invention relates to a thruster for propulsion of a satellite. In particular, the invention relates to a Liquid Metal Ion Thruster (LMIT) formed from an array of wetted tips.

BACKGROUND OF THE INVENTION

Since the mid 1960s, near-earth space has been populated by ever larger spacecraft, typically today in the ~1000 kilogram category, launched and boosted into Geosynchronous Earth Orbit (GEO) for communications, or Low Earth Orbit (LEO) for mapping and defense purposes. There is a rapidly growing commercial demand for small satellites of 100-200 Kg mass in sun-synchronous Low Earth Orbit (LEO) of approximately 200 nautical miles, but a significant reduction in the cost of access to orbit for small payloads is essential for success of the emerging commercial space industry. Today's high costs are justified mostly by defense needs, or by launching large satellites into GEO where their useful life is long enough to justify amortized life-cycle costs. Modern satellite launches into LEO use chemical propulsion systems, such as liquid or solid propellant single-stage and multi-stage rockets. Innovative approaches not yet made practical include launching at high altitude from airborne platforms. Advances in structural materials will be one key enabling technology to meeting the challenging cost-to-LEO target. Nano-composite materials could increase the strength/mass ratio of rocket structures and lead to single-stage to orbit with higher payload and hence reduced cost/kilogram delivered to LEO. Exotic chemical propellants that generate higher exhaust velocities would also increase payload delivered to LEO for a given launch pad mass, and hence reduce launch costs.

Small satellites in LEO will place more demands on micro-spacecraft in the 1 kg-10 kg class and small satellites in the ~100 kg class. With increasing ability to integrate cameras and sophisticated communications systems, the demand for propulsion systems for small (and inherently power limited) spacecraft will grow.

In modern satellites, high thrust for rapid maneuvers has been provided to spacecraft by chemical propulsion, such as hydrazine and other rocket motors. The exhaust velocity of such chemical rockets is limited by the inherent specific energy released by combustion, to ~2500-3000 m/s. Due to this limited speed, chemical rockets burn up more propellant to effect an orbital maneuver than would other forms of propulsion that offer higher exhaust speeds. These include electro-thermal rockets and electric propulsion. In electro-thermal rockets, the chemical energy released by the propellant is augmented by additional energy input via an external heater. The higher exhaust speeds possible are limited by the temperature at which the rocket nozzle may be safely operated. Electric propulsion is the most efficient in terms of propellant utilization, as it offers much higher exhaust speeds. This is possible because electric rockets add energy to passive propellants via external means and contain the high energy propellant ions or plasma in electromagnetic fields, so that they are not in contact with material walls. Thus the usual limitation on propellant temperature is removed. At high temperatures, exhaust speeds in the 10,000-30,000 m/s range are possible for plasma rockets, while electrostatic ion engines may boost the exhaust speed of ions to still higher velocities, (>100,000 m/s) limited only by breakdown of vacuum gaps at high voltages. Such an order-of-magnitude higher exhaust speed for electric rockets makes them far more efficient in terms of propellant utilization for in-space maneuvers. To illustrate this by example, consider a 100 kg satellite that must be moved in its orbit by a change in orbital velocity of 2000 m/s. If a chemical rocket with 100N of thrust and an exhaust speed of 3000 m/s is used, the orbital maneuver would take about 24 minutes to complete, with a fuel consumption of 49 kg which implies that only half of the initial 100 Kg spacecraft mass would arrive at the destination. By contrast, for an electric propulsion engine with thrust of only 1N, but having an exhaust speed of 30,000 m/s, the same orbital maneuver would take 54 hours but consume only 6.5 kg of propellant, so nearly 94% of the initial mass would be delivered to its destination. The cost/kg of useful payload delivered would be half as much as with the chemical propulsion, in exchange for a longer mission duration. As the required velocity change becomes larger and larger relative to the exhaust speed, chemical propulsion becomes far less efficient. For example, if in the above example, the velocity change were increased from 2 km/s to 4 km/s, the chemical rocket would deliver only 26 kg of the original 100 kg to its destination, vs. 88 kg for the electric rocket. This factor of 3.3 higher useful payload could significantly reduce costs to move objects in space. The above example is illustrative of the general advantage of higher exhaust speed in space. However, the example also shows that the price paid for higher speed electric rockets is often a much longer mission duration, due to the typically much lower thrust offered by such engines, relative to their chemical counterparts. For a given efficiency, the thrust T and exhaust speed are inversely related via:

$$T = \frac{2P_e \cdot \eta}{u_{exhaust}}$$

with $P_e$ being the power into the thruster, $\eta$ the overall thruster efficiency and $u_{exhaust}$ the exhaust velocity of the rocket engine. As the above example illustrates, chemical rockets have given high thrust but at low exhaust velocity, while electric rockets have given low thrust at high velocities. Orbital maneuvers in space could be dramatically improved if a single propulsion engine were available that offered variable exhaust speed and thrust for a fixed power input at high efficiency. With such an engine, one could operate at high thrust and lower velocity for rapid maneuvers that consume more fuel, but reduce to low thrust at very high velocity, to accomplish slower missions far more efficiently. Rather than carrying two completely different types of engine on board to accomplish this (as is done today) one could utilize a single electric engine to do both tasks.

A new type of electric thruster is known as a Liquid Metal Ion Thruster (LMIT). LMITs offer the advantage that they can be integrated into Micro-Electro-Mechanical-System (MEMS) structures, very similar to current systems being used for field emitters in plasma displays. An LMIT works by producing a high velocity ion current via field emission from a liquid metal source. A high voltage is applied between an extractor electrode at cathode potential and a liquid metal coated field enhancing structure like a small (micron radius) sharp tip. The high voltage leads to the formation of tiny micro tips protruding from the liquid metal surface, known as Taylor cones. These Taylor cones enhance the applied electric field further, leading to a condition where ions can "tunnel" out of the liquid phase into vacuum. The applied extraction voltage accelerates the ions to a velocity u, $$u_{exhaust} = \sqrt{\frac{2eV}{m_{ion}}}$$

where:

e as the elementary charge (1.6×10−19 Coulomb),

V is the extraction voltage, and $m_{ion}$ is the mass of the individual ion.

In LMIT systems with increasing extractor voltage, the velocity and the number of ions extracted increase and essentially more thrust is produced.

PRIOR ART

U.S. Pat. No. 4,328,667 by Valentian et al. describes a liquid metal ion thruster assembly having a plurality of hollow-cone tips coupled to a reservoir of liquid metal, where the metal ions are drawn from the tip by the electrostatic force generated by an adjacent electrode.

U.S. Pat. Nos. 6,097,139 and 6,741,025 by Tuck et al. describe the use of impurities on a surface for the formation of enhanced electric fields for use as composite field emitters.

U.S. Pat. Nos. 6,516,024 by Mojarradi et al. and 6,996,972 by Song describe a hollow tip liquid ion extractor assembly for generation of thrust.

U.S. Pat. No. 7,059,111 describes a thruster whereby liquid metal ions are boiled from a reservoir and electro-statically attracted through a cylindrical ring, thereby generating thrust.

U.S. Pat. Nos. 6,531,811 and 7,238,952 describe an ion extractor having a reservoir opposite a needle tip and an extractor electrode.

OBJECTS OF THE INVENTION

A first object of the invention is a liquid metal ion thruster having an array of pedestals, each pedestal having one end attached to a substantially planar substrate, and an opposite end tapering to a tip located on a pedestal axis, an extractor electrode co-planar to said substrate and located above said pedestal tip, the extractor electrode having an aperture for the emission of ions at the intersection of each pedestal axis with the extractor electrode, the pedestals and planar substrate having a wetted surface for the conduction of a liquid metal suitable for ionization and extraction from the tip of each pedestal.

A second object of the invention is a liquid metal ion thruster having an array of pedestals, attached to a substantially planar substrate, each pedestal having one or more grooves on the surface of the pedestal which are substantially parallel to the axis of each pedestal, the grooves carrying liquid metal from the substrate to the tip of the pedestal, an extractor electrode co-planar with the planar substrate for drawing ions from the pedestals, the extractor electrode having a plurality of apertures located on the axis of each pedestal, and a plurality of focusing electrodes located co-planar to the extractor electrode and forming the extracted ions into a stream of flows substantially parallel to the axis of the associated pedestal.

A third object of the invention is a liquid metal ion thruster having an array of pedestals, one end of each pedestal attached to a substantially planar substrate, and the other end formed into a tip having an axis, the axis of each tip forming an ion flow axis, an extractor electrode co-planar to the substrate and having apertures for each ion flow axis, one or more focusing electrodes co-planar to the extractor electrode and having an aperture for each ion flow axis, the focusing electrode producing a substantially co-linear flow of extracted ions, and a source of neutralizing electrons applied to the co-linear flow of extracted ions to produce a neutral charge to ensure continued co-linear ion flow beyond the extent of the focusing electrodes.

SUMMARY OF THE INVENTION

In a first embodiment of the invention, a substrate is formed which includes a plurality of pedestals, each pedestal having an axis, each pedestal having one end attached to the substrate, and the pedestal having an opposite end which tapers to a tip. Parallel to the planar substrate and located above the pedestal tips is a substantially planar extraction electrode which has apertures located at the intersection points of the axis of each pedestal and the extraction electrode. The surface of the substrate and the pedestals is wetted with a liquid metal such that in operation, a film of liquid metal coats the substrate and pedestals. Upon application of an electric potential between the extraction electrode and the pedestals, which are connected to each other and the substrate through the liquid metal, the liquid metal at the tips of the pedestals forms an ion beam. The reaction force of the ions results in the generation of a thrust.

In another embodiment of the invention, the pedestals have surface grooves which are parallel to the pedestal axis and provide a conduit for liquid metal.

In another embodiment of the invention, the pedestals have surface grooves or channels which are parallel to the pedestal axis, and additionally the substrate has surface grooves or channels which interconnect the pedestals to each other and also to a reservoir of liquid metal.

In another embodiment of the invention, the pedestals have surface roughness on their tapered opposing end segments that allows surface capillary flow of liquid metal from the surface grooves or channels which are parallel to the pedestal axis, to the tips of the pedestals. Without such surface roughness, capillary flow will be inhibited from moving along the tapered opposing end portions of the pedestals towards their sharp points.

In another embodiment of the invention, the pedestals have surface grooves or channels which connect at one end, to the surface grooves or channels that are along the sides of the pedestals, and at the other end converge to the tip of the pedestal. These converging channels along the tapered opposing end surface must have channel widths that decrease towards the point and are designed to allow continuous and stable flow of liquid metal from the surface grooves or channels which are parallel to the pedestal axis, to the tips of the pedestals. Without such decreasing channel width along the tapered opposing end of the pedestals, capillary flow will be inhibited from moving along the tapered opposing end portions of the pedestals towards their sharp points.

In another embodiment of the invention, the extraction electrode has a parallel set of planar electrostatic focusing electrodes such that each pedestal generates a flow of ions that is substantially parallel to the pedestal axis.

In another embodiment of the invention, the extractor electrode is coated with an insulator.

In another embodiment of the invention, the region below the pedestal tips and planar substrate contains an insulating material.

In another embodiment of the invention, the liquid metal is indium and the extractor electrode is insulated.

In another embodiment of the invention, the liquid metal on the substrate is indium at a sufficient temperature to keep it in the liquid state, and the extractor electrode is coated with indium at a sufficient temperature to keep it in a solid state.

DETAILED DESCRIPTION OF THE INVENTION

Figure 1:
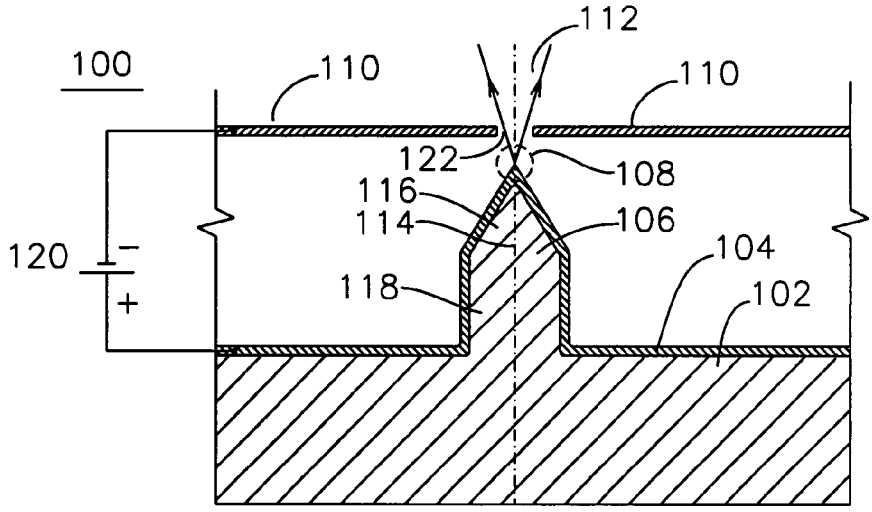
FIG. 1 shows a cross sectional view of a liquid metal ion thruster (LMIT).

FIG. 1 shows one embodiment of a liquid metal ion thruster (LMIT) according to the present invention, the thruster having a substrate 102, a substrate pedestal 118 with a central axis 114, where the pedestal 118 has one end formed from or attached to the substrate 102, and the pedestal has a tapered opposing end 116. Covering the substrate and pedestal is a film of liquid metal 104 at a potential such as 0V with reference to a voltage source 120. A negative potential is applied to an extractor electrode 110 which draws liquid metal ions from the tip to form an ion stream 112 which passes through an aperture 122 centered about the pedestal axis 114.

The particular liquid metals which are good candidates for use in a liquid metal ion thruster include Indium, Gallium, alloys of these metals, and more broadly, metals with a melting point in the range of 300° K. to 700° K.

Figure 2:
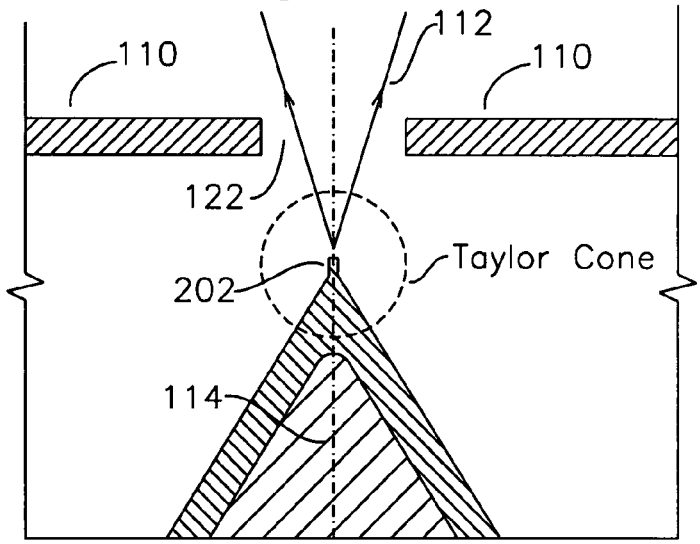
FIG. 2 shows a detailed view of a pedestal tip of FIG. 1.

The pedestal typically has circular symmetry about its axis 114, and may include features such as grooves or scallops cut into the pedestal outer surface to act as channels for the conduction of liquid metal from the planar substrate 102 up the walls of the pedestal 118 via the grooved channels, and to the emission tip 108. The liquid metal travels along patches of surface roughness or along the narrowing channels that converge to the pedestal tip, where the separating ions respond to the concentrated electric field by forming a Taylor cone. FIG. 2 shows magnified details of the structure of FIG. 1, including Taylor cone 202, which forms the critical region where the liquid metal forms a tip further concentrating the enhanced electric field density and such that ions are drawn from the surface of the Taylor cone and accelerated by the electric field potential of the extractor electrode 110 to form ion streams 122.

The choice of a substrate is often governed by the ease of machining, often using chemical etching or chemical machining, as is known in the art of Micro-Electro-Mechanical Systems (MEMS), where features are etched on a substrate material such as Silicon. Although easily etched, one difficulty of Silicon is that it is not easily wetted by liquid metal candidates such as Indium or Gallium, so the substrate may require a metal coating, such as Titanium, Molybdenum, or Tungsten over Nickel, or any combination of these metals. Finally, a surface roughening may be applied to the layer of metal coating in contact with the liquid metal of the thruster, which may improve liquid metal flow over this surface.

There are several operational requirements for optimum operation of the device shown in FIGS. 1 and 2:

1) It is critical that a continuously wetted surface be available from the substrate surface to the tip of the emitter, particularly in the regions responsible for feeding liquid metal to the Taylor cone.

2) Ionic emissions from the Taylor cone should be accelerated by the electric field formed by extraction electrode 110, but the ions should pass through aperture 122 such that the ions do not deposit on the extractor electrode 110, as this would reduce the thrust efficiency and operational lifetime of the thruster.

3) Due to the small size of the pedestal and its features, it is desired to form the substrate and pedestal from silicon using machining techniques such as those used in MEMS, where the substrate may be silicon and the features of the substrate including the pedestal etched using photolithographic or direct erosion etching techniques, or any chemical machining technique known in the art of MEMS device fabrication.

4) It may be advantageous to apply a surface metallization after machining the substrate and pedestals such that the surface metallization will ease the initial application of a liquid metal propellant with a low melting temperature, such as Indium or Gallium, which also has an undesirably high surface tension and tends to resist forming initial conformal coatings, instead forming isolated spherical depositions when sputtered.

In addition to the grooved features of the pedestals, enhanced liquid metal flow results where the pedestal grooves or scallops, and optionally substrate grooves or depressions, have surface roughness on their tapered opposing end segments that allows surface capillary flow of liquid metal from the surface grooves or channels which are parallel to the pedestal axis, with the surface roughness continuing up the sides of the pedestal to the tip. Without such surface roughness, capillary flow will be inhibited from moving along the tapered opposing end portions of the pedestals towards their sharp points. In the best mode, the surface roughness Ra for the conduction of liquid Indium is on the order of 5μ (in the range of 0.1μ to 5μ), however the roughness may be varied to improve liquid metal flow according to the flow characteristics of the particular metal or metal alloy being supported. Surface roughening of the coating which will be in contact with the liquid metal may be accomplished by chemical etching, method of sputtering, or any technique which results in the required surface roughness Ra.

Figure 3A:
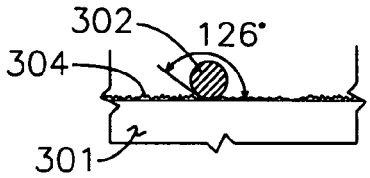
FIG. 3A shows Indium applied to an un-wetted surface.
Figure 3B:
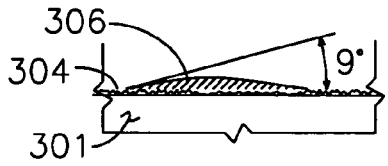
FIG. 3B shows Indium applied to a wetted surface.
Figure 3C:
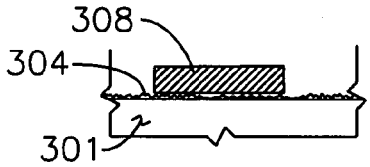
FIG. 3C shows a cross section view of bulk Indium applied to a wetted surface.
Figure 3D:
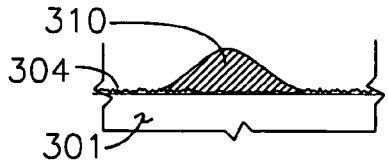
FIG. 3D shows a cross section view of bulk Indium applied to a wetted surface as in FIG. 3C, after being heated to its melting temperature.
Figure 4:
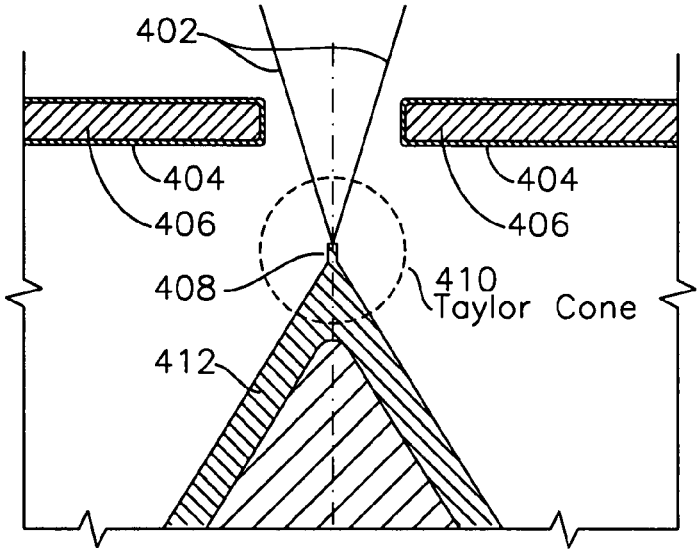
FIG. 4 shows the sectional view of an LMIT with an insulated extraction electrode.

FIG. 3A shows the substrate 301 which has been coated 304 with a thin layer of Tungsten or Molybdenum applied using a sputter coating technique, or any technique which provides for a roughened surface for mechanical bonding of the later-applied Indium to the roughened surface. Typically, the substrate 301 must be coated with a metallization 304 thickness of at least 10,000 Å, which allows the metallized surface to be etched and roughened in preparation for the introduction of Indium 302. As Indium has a high surface tension, depositions of this material tend to gather in spherical depositions 302, where the degree of surface tension may be measured by the angle between the substrate and the contact surface of the material to be wetted 302, shown as 126 degrees. FIG. 3B shows the result of applying a plasma jet to FIG. 3A, whereby the spherical metal 302 spreads sphere 302 over the roughened surface 304 of the substrate 301 and the metal is spread, with the surface tension angle reduced to 9 degrees. In one embodiment of the invention, a plasma jet is used to spread the Indium over the surface, thereby resulting in an initial wetting which allows for continuous liquid flow to replace the ions which are accelerated away in the Taylor cone tip. FIG. 3C shows an alternate method of Indium application, where bulk Indium 308 is applied to roughened metallic surface 304 over substrate 301, and after heating the Indium flows over the original extent of application, leaving an uneven deposition 310, the excess of which may be removed such as by centrifugal force while the Indium is in a liquid state, thereby realizing an Indium wetted surface. The roughened metallization 304 may be heated directly or indirectly such as by magnetic induction, or any method which results in a reliable wetted interface between the Indium 306/310 and metallization surface 304. FIG. 4 shows another embodiment of the thruster, whereby the extraction electrode 406 is coated with an insulating material such as a 1000 Å thick coating 404 of aluminum oxide, or alumina. This insulating coating reduces the likelihood of Indium ions depositing on the insulated surface of the electrode 406 during operation.

Figure 5:
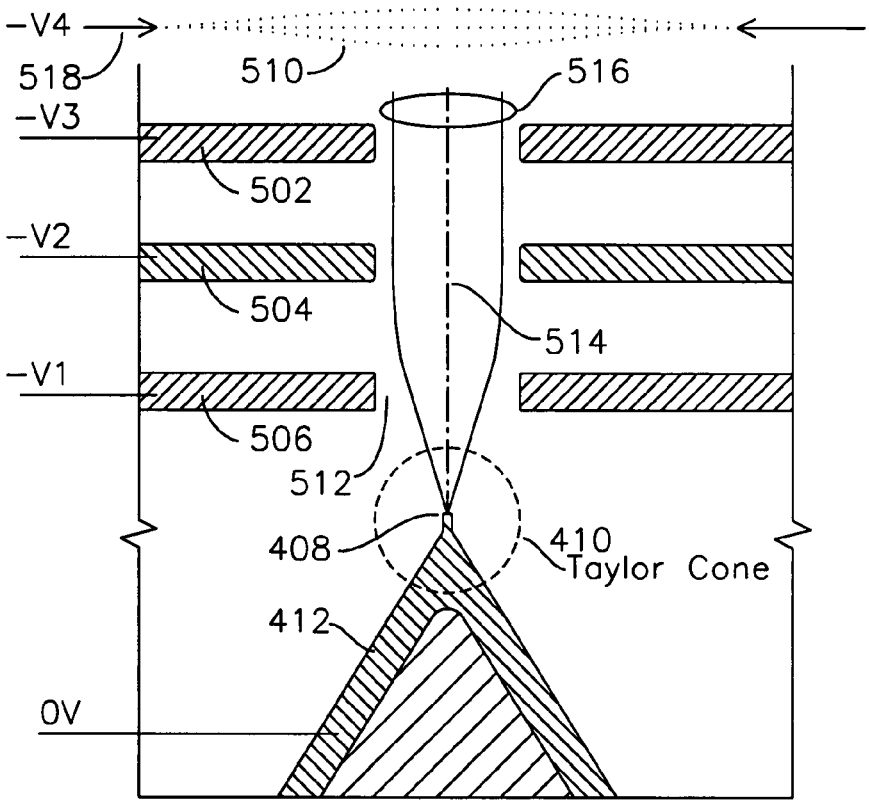
FIG. 5 shows a sectional view of an LMIT with ion beam focusing electrodes and ion charge neutralizer.

FIG. 5 shows another embodiment of the invention, whereby the ions form a Taylor cone 408 and are accelerated to the exit aperture 512 about the pedestal axis 514 by the extraction electrode 506, and then focused into parallel paths 516 using electrostatic potentials applied by focusing electrodes 504 and 502. The number of focusing electrodes and inter-electrode spacing may vary according to the application, but the objective of the focusing electrodes 504 and 502 is to produce substantially parallel ion trajectories at the exit point of the thruster. Optionally, it may also be helpful to remove residual charges in the emitted ions by spraying a source of negatively charged ions or electrons 510 at the accelerated Indium ions 516, thereby minimizing the space charge effect, whereby the like-charged Indium ions tend to repel each other and generate a larger plume of ions than would be produced by charge neutralized ions. One objective of the charge neutralization electrode 518 and electrostatic focusing electrodes 502 and 504 is to reduce the number of ions returning to the thruster and assemblies around the thruster, such as satellite antennas.

Figure 6:
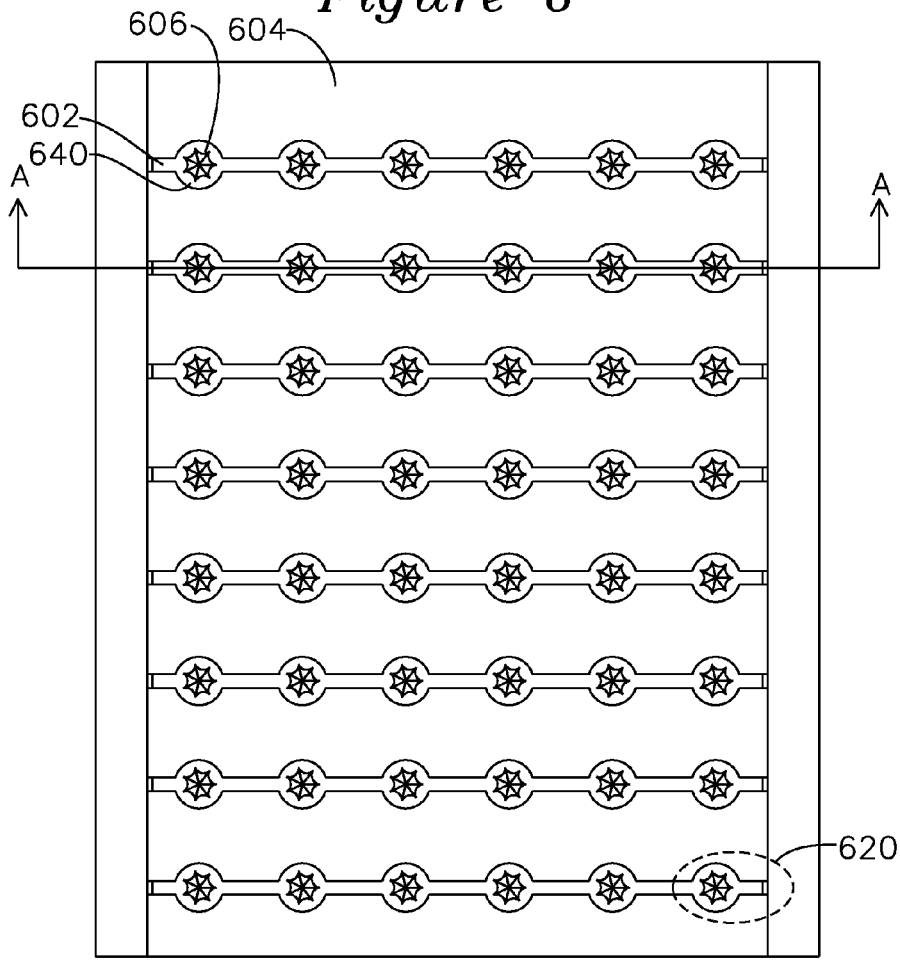
FIG. 6 shows a thruster having an array of pedestal tips.
Figure 7:
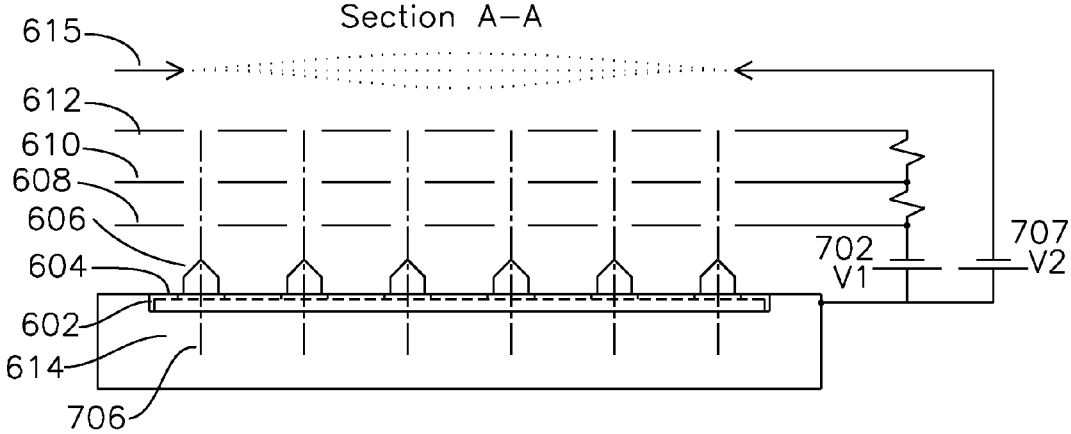
FIG. 7 shows a cross sectional view of FIG. 6.

FIG. 6 shows an ion thruster which comprises an array of pedestal emitters 606 on a substrate 604 with liquid metal feed channels 602 formed into the substrate and coupled to a dispenser 614 of FIG. 7, where the dispenser may contain a low melting point metal which is heated to slightly above the melting point, such as Indium impregnated into a dispenser 614 formed from porous tungsten, or any other dispenser means for storing Indium and allowing it to wick through the substrate surface channels 602. Positioned substantially parallel to the surface of the substrate is an ion extractor electrode 608, and first focus electrode 610 and second focus electrode 612, each electrode at a different potential provided by voltage sources V1 702 referenced to the liquid metal on the substrate surface, and the electrodes having an aperture corresponding to each pedestal axis such as 706 for attracting, forming, and focusing the ion beam. The liquid metal reservoir 614 is coupled to the feed channels 602 such that the liquid metal flows from the reservoir 614 along the wetted channels 602 which form wells 640 around the pedestals such as 606, such that the liquid metal is drawn up the grooves or channels 606 of each pedestal to the tip region where the Taylor cone is formed and ions are electrostatically attracted and released by the electric field produced by extractor electrode 606, the ion stream is focused by electrodes 610 and 612, and the ion stream is neutralized by charge balance injector 615. The charge balance injector 615 is coupled to the negative terminal of a voltage source V2 704, and generates a cloud of negatively charged particles to neutralize the positively charged metal ions that have been accelerated from the tips such as 606. The provision of this negative charge into the ion cloud results in the reduction of space charge spreading of the emitted ion stream. FIG. 7 also shows a side view of the extractor electrode 608, focus electrodes 610 and 612, which are formed from substantially planar sheets of metal with apertures disposed above the center axis of each pedestal emitter such as 606, and co-planar with the substrate surface 604.

Figure 8:
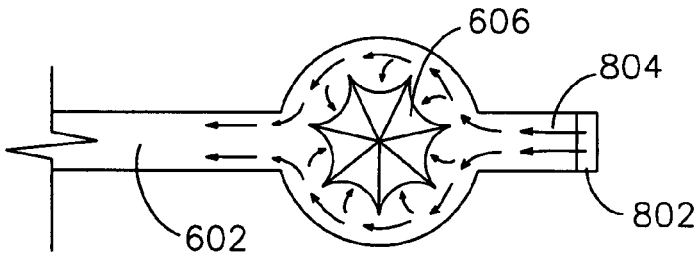
FIG. 8 shows the plan view of a pedestal tip.
Figure 9:
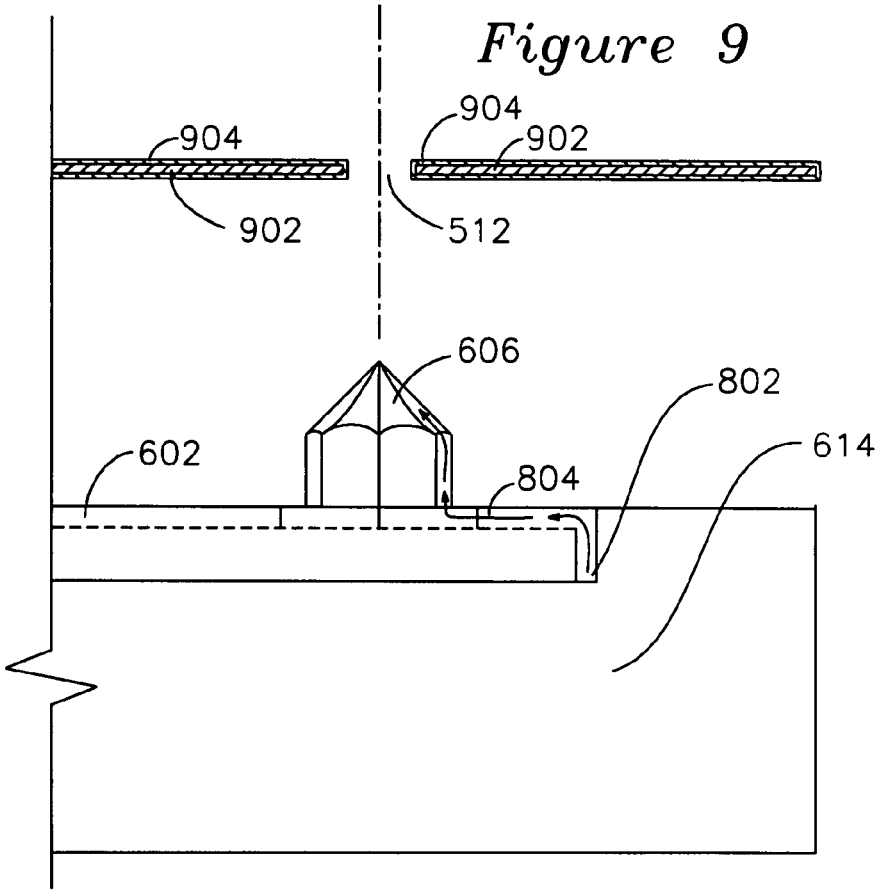
FIG. 9 shows a sectional view of the pedestal tip, substrate, and liquid metal reservoir.

FIG. 8 shows a detailed view of the pedestal and grooves 620 of FIG. 6. The substrate surface grooves 602 are coupled to the reservoir through an aperture 802, such that liquid metal flows 804 as shown through the channel 602 and at each pedestal is drawn upwards to the grooves disposed in each pedestal 606. FIG. 9 shows a side detail view, including liquid metal reservoir 614, aperture 802, channel 602, and pedestal 606. Reservoir 614 may store the liquid ion propellant such as Indium in bulk, or alternatively, reservoir 614 may be a porous material with a high melting point such as porous tungsten.

In an alternate embodiment for the extractor electrode 902 shown in FIG. 9, the extractor electrode 904 may be coated with a thin layer of the same material used for the liquid ion source, such as Indium. By maintaining the temperature of electrode 902 such that the surface coating of Indium 902 is in the solid phase, the emitted plasma jet of Indium from the Taylor cone region of the tip of the pedestal 606 which deposits onto the Indium surface 902 of the extraction electrode 902 is unable to deposit extractor electrode material 902 back to the pedestal tip 606 through high temperature atomic sputtering, which contamination would cause failure of the Taylor cone associated with pedestal tip 606, and eventually, failure of the entire thruster array. Therefore, coating the extractor electrode 902 with material identical to the liquid metal ion source greatly reduces the failure caused by electrode material 902 sputtering back to the pedestal tip 606. The Indium-coated extractor electrode 902 may be used in combination with any of the other pedestal tips and channels geometries previously described or in the prior art. Alternatively, in applications where the extractor electrode is likely to achieve high temperatures and the Indium coating 904 would be in the undesirable liquid phase, the coating 904 may be Indium oxide instead, which has a much higher melting temperature than elemental Indium.

Figure 10:
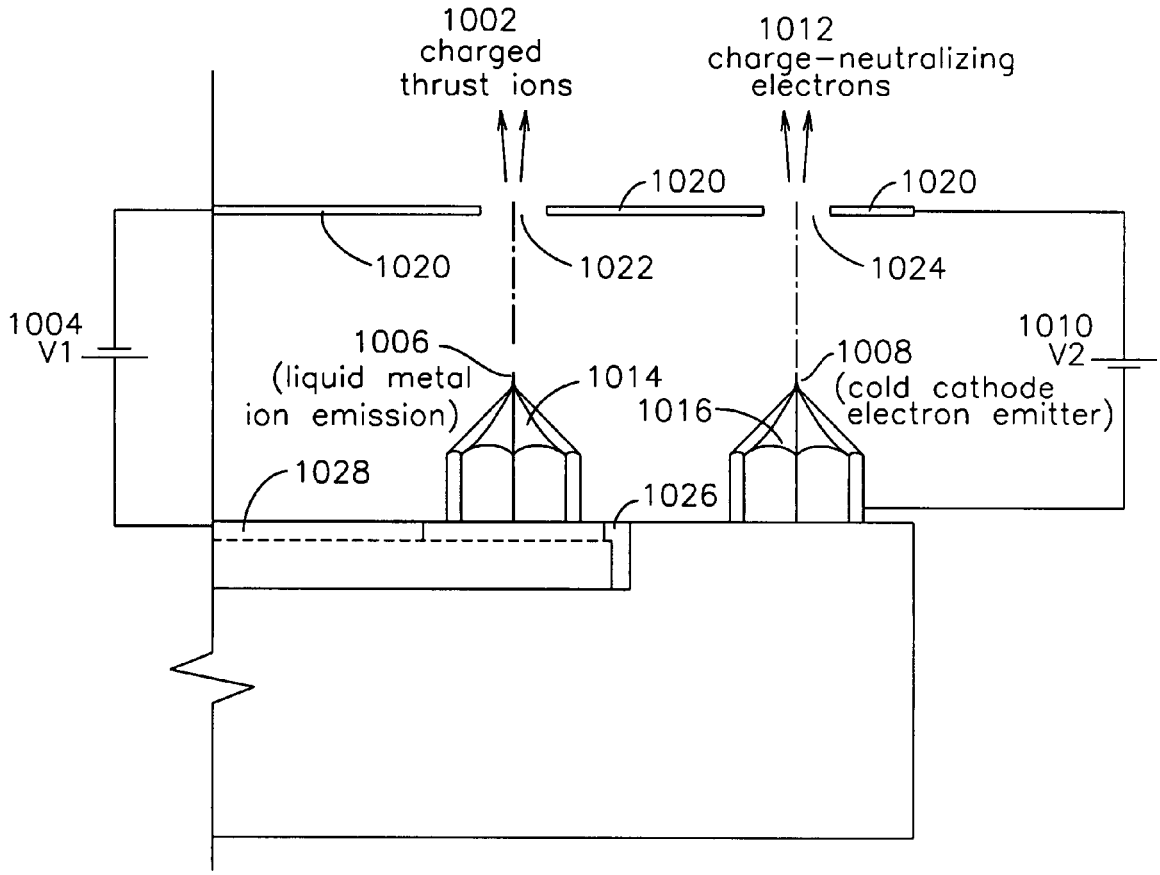
FIG. 10 shows the side view of a liquid metal ion thruster with a cold cathode electron emitter for space charge neutralization.
Figure 11:
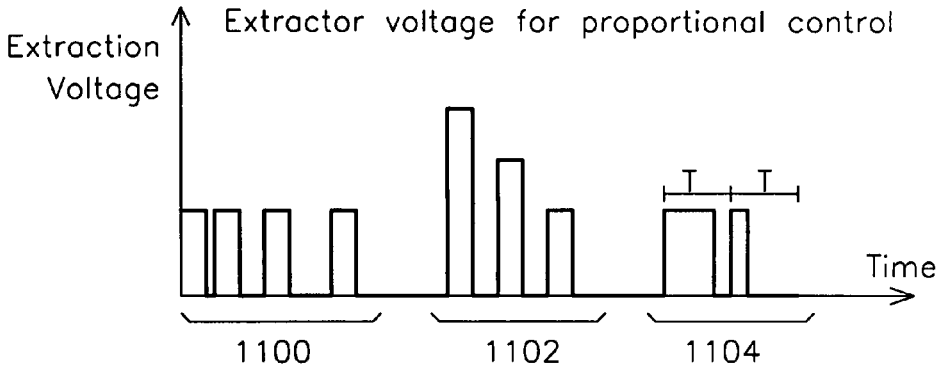
FIG. 11 shows extractor voltage waveforms for proportional control of thruster force.

One problem of an ion thruster is that the ion stream tends to spread and disperse over distance because of internal space charge effects, where the similarly charged ions repel away from each other. Furthermore, in the absence of a charge neutralizing cloud, the positively charged ion cloud leaving the spacecraft will cause the potential on the spacecraft to become negative, eventually applying a braking force on the ion cloud and pulling it back towards the spacecraft. This space charge effect will reduce the thrust to zero, as there will be no net flow of positive ions away from the spacecraft. This problem may be reduced or eliminated by using a source of electron injection as was shown in the charge neutralizing structure 615 of FIG. 7. FIG. 10 shows another embodiment of the present invention where an ion thruster pedestal tip 1014 provides a source of liquid metal ions which form a Taylor cone 1006 at the tip, and the ions are attracted to an extraction electrode 1020 with the potential difference V1 provided by voltage source 1004, as was described earlier. An electron emitter pedestal 1016 which is electrically isolated from the liquid metal ion pedestal 1014 may contain a small amount of metal sufficient to form a Taylor cone 1008 when the pedestal 1016 is elevated to a temperature sufficient for the metal at the tip of pedestal 1016 to flow and form a Taylor cone 1008 in response to a voltage V2 applied to source 1010. During the Taylor cone forming phase, the pedestal 1008 would have an electrical potential that is positive with respect to extraction electrode 1020. Then, during a second cooling phase, the potential V2 1010 would remain while the electron emission pedestal 1016 is cooled until the liquid metal Taylor cone is preserved as a solid metal tip. During a third operational phase, the electron emission pedestal 1016 and hardened Taylor cone tip 1008 may be used as a cold cathode electron emitter, which produces a stream of electrons 1012 which are attracted by extraction electrode 1020 which is now has a positive voltage V2 with respect to the pedestal 1016. The volume of the stream of electrons 1012 from the hardened Taylor cone 1008 is selected to mix with and neutralize the stream of charged ion thrust particles 1002 to eliminate the space charge of the plume of ions, thereby preventing ions from returning to the thruster and structures nearby the thruster.

In another embodiment of the invention, the ion extraction voltage sources such as V1 1004 of FIG. 10, V1 702 of FIG. 7, V1 of FIG. 5, and voltage source 120 of FIG. 1 may be time-varying voltages. The nature of the extraction voltage over time may be a duty cycle modulated voltage that steps to a constant voltage level for varying amounts of time as shown in waveform 1100, or it may step from a first voltage to a varying second voltage at fixed amounts of time as shown in waveform 1102, or it may step to a fixed voltage for varying amounts of time on a fixed period, as shown in the waveform 1104, or any combination thereof which allows fine control of the ion stream strength while allowing the optimal operation of the thruster, particularly in the formation of the critical Taylor cones at the tips of the pedestals. It is also clear to one skilled in the art that the voltages of other structures, such as the voltages applied to the focusing electrodes and electron generation structures would vary accordingly to achieve the objectives of ion beam collimation and charge neutralization, respectively.

The particular embodiments described herein are for example only. It is clear that the various embodiments can be practiced separately or in combination. In particular, the various forms of liquid metal reservoir, the various liquid metals used as ion sources, the coatings or insulations applied to the extractor electrode, the types and number of focusing electrodes, the various structures of the ion charge neutralizers, and the manner in which voltage is applied to the ion extractor electrode to regulate and control the amount of thrust are each independent variations of the thruster invention which may be practiced alone or in combination.

We claim:

1. A liquid metal ion thruster, the thruster having:

a substrate having a plurality of pedestals formed on a substantially planar surface, the plurality of pedestals having a first height above said otherwise planar surface; each said pedestal having an axis substantially perpendicular to said planar surface, each said pedestal having a plurality of channels placed axially on a pedestal surface and coupled to a plurality of channels in said substrate surface;

an extractor electrode substantially parallel to said planar substrate, said extractor electrode having an aperture above each said pedestal;

a reservoir for a liquid metal, the reservoir coupled to said substrate channels;

wherein the liquid metal passes through the aperture to produce thrust.

2. The liquid metal ion thruster of claim 1 where said substrate includes grooves disposed on said substantially planar surface coupling said reservoir to said pedestals.

3. The liquid metal ion thruster of claim 1 where at least one said pedestal has at least one groove from said pedestal base to said pedestal tip.

4. The liquid metal ion thruster of claim 1 where said substantially planar substrate and at least one said pedestal has interconnected depressions for the conduction of liquid metal from said reservoir to said pedestal tip.

5. The liquid metal ion thruster of claim 1 where said reservoir has at least one of the metals Indium, Gallium, or a metal with a melting point in the range 300° K. to 700° K.

6. The liquid metal ion thruster of claim 1 where said substrate is silicon and said grooves are formed using an etching process.

7. The liquid metal ion thruster of claim 1 where said substrate is coated with at least one of Titanium, Molybdenum or Tungsten over Nickel, which coating is subsequently etched to a surface roughness in the range 0.5μ to 5μ.

8. The liquid metal ion thruster of claim 1 where said reservoir and said pedestals are on opposing sides of said substrate.

9. The liquid metal ion thruster of claim 1 where said reservoir is formed from porous tungsten.

10. A liquid ion metal thruster, the thruster having:

a substrate having a plurality of pedestals formed on a substantially planar surface, the plurality of pedestals having a first height above said otherwise planar surface;

each said pedestal having an axis substantially perpendicular to said planar surface, each said pedestal having a plurality of channels placed axially on a pedestal surface and coupled to a plurality of channels in said substrate surface;

an extractor electrode substantially parallel to said planar substrate, said extractor electrode having an aperture above each said pedestal, said extractor electrode having a potential with respect to said liquid metal sufficient to draw ions from said pedestal;

a reservoir for a liquid metal, the reservoir coupled to said substrate channels;

one or more focusing electrodes substantially parallel to said extractor electrode, said focusing electrodes having an aperture about each said pedestal axis, said focusing electrodes having a potential with respect to said liquid metal sufficient to form said ions from said pedestal tips into substantially parallel trajectories;

wherein the liquid metal passes through the aperture of said extractor electrode to produce thrust.

11. The liquid metal ion thruster of claim 10 where at least one of said substrate or said pedestal has at least one groove connecting said reservoir to said pedestal, and said pedestal has a roughened surface.

12. The liquid metal ion thruster of claim 10 where said reservoir is formed from porous Tungsten.

13. The liquid metal ion thruster of claim 10 where said reservoir contains at least one of Indium, Gallium, or an alloy with a melting point of 300° K. to 700° K.

14. The liquid metal ion thruster of claim 10 where said substantially planar substrate is coated with at least one of Tungsten or Molybdenum, or Titanium, said coating having a roughness in the range 0.5μ to 5μ.

15. A liquid ion metal thruster, the thruster having:

a substrate having a plurality of pedestals formed on a substantially planar surface, the plurality of pedestals having a first height above said otherwise planar surface;

each said pedestal having an axis substantially perpendicular to said planar surface, each said pedestal having a plurality of channels placed axially on a pedestal surface and coupled to a plurality of channels in said substrate surface;

an extractor electrode substantially parallel to said planar substrate, said extractor electrode having an aperture above each said pedestal, said extractor electrode having a potential with respect to said liquid metal sufficient to draw ions from pedestal;

a reservoir for a liquid metal, the reservoir coupled to said substrate channels;

one or more focusing electrodes substantially parallel to said extractor electrode, said focusing electrodes having an aperture about each said pedestal axis, said focusing electrodes having a potential with respect to said liquid metal sufficient to form said ions from said pedestal tips into substantially parallel trajectories;

a charge neutralizer injecting negative ions or electrons into said ions originating from said pedestal tips after they have passed through said focusing electrode apertures, said negative ions or electrons sufficient in numbers to reduce a space charge of said ions originating from said pedestal tips;

wherein the liquid metal passes through the apertures of said extractor electrode to produce thrust.

16. The liquid metal ion thruster of claim 15 where said charge neutralizer is a subset of said pedestals which are electrically isolated from the remaining said pedestals, the subset of pedestals having a negative potential compared to said extraction electrode.

17. The liquid metal ion thruster of claim 15 where at least one of said substrate or said pedestal has at least one groove connecting said reservoir to said pedestal.

18. The liquid metal ion thruster of claim 15 where said reservoir is porous tungsten.

19. The liquid metal ion thruster of claim 15 where said reservoir contains at least one of Indium, Gallium, or a metal with a melting point between 300° K. and 700° K.

20. The liquid metal ion thruster of claim 15 where said substrate and said pedestals are coated with at least one of Titanium, Molybdenum, or Tungsten, said coating has a roughness in the range 0.5 u to 5 u.

* * * * *

UNITED STATES PATENT AND TRADEMARK OFFICE

CERTIFICATE OF CORRECTION

PATENT NO. : 7,827,779 B1
APPLICATION NO. : 11/900372
DATED : November 9, 2010
INVENTOR(S) : Mahadevan Krishnan et al.

It is certified that error appears in the above-identified patent and that said Letters Patent is hereby corrected as shown below:

Column 5, line 47 "in the range of 300° K. to 700° K." should be changed to --in the range of 300° K to 700° K.--

Column 10, line 17 "in the range of 300° K. to 700° K." should be changed to --in the range of 300° K to 700° K.--

Column 10, line 63 "with a melting point of 300° K. to 700° K." should be changed to --with a melting point of 300° K to 700° K.--

Column 11, line 13-14 "metal sufficient to draw ions from pedestal" should be changed to --metal sufficient to draw ions from said pedestal--

Column 12, line 19 "with a melting point between 300° K. to 700° K." should be changed to --with a melting point between 300° K to 700° K--

Signed and Sealed this
Thirteenth Day of September, 2011

David J. Kappos

David J. Kappos
*Director of the United States Patent and Trademark Office*